United States Patent [19]

Pinczykowski

[11] Patent Number: 4,892,238

[45] Date of Patent: Jan. 9, 1990

[54] CLOTHES PRESS HANGER

[76] Inventor: Dorothy Pinczykowski, 212 West 91st St., New York, N.Y. 10024

[21] Appl. No.: 362,875

[22] Filed: Jun. 7, 1989

[51] Int. Cl.[4] ..... A47G 25/14; A47B 61/02

[52] U.S. Cl. ..... 223/92; 223/94; 223/95

[58] Field of Search ..... 223/68, 69, 71, 74, 223/85, 88, 89, 92, 94, 95

[56] References Cited

U.S. PATENT DOCUMENTS

| | | | |
|---|---|---|---|
| 1,990,454 | 2/1935 | Johnston | 223/69 |
| 2,608,324 | 8/1952 | Currier | 223/95 |
| 2,757,835 | 8/1956 | Scheck | 223/88 |
| 4,186,858 | 2/1980 | Tatematsu | 223/94 |
| 4,556,158 | 12/1985 | Blanchard et al. | 223/88 |

FOREIGN PATENT DOCUMENTS

| | | | |
|---|---|---|---|
| 673569 | 3/1939 | Fed. Rep. of Germany | 223/92 |

*Primary Examiner*—Werner H. Schroeder

*Assistant Examiner*—Jodi A. Tokar

*Attorney, Agent, or Firm*—Goodman & Teitelbaum

[57] ABSTRACT

A clothes press hanger including a body member having a hook member extending upwardly therefrom and pairs of arms and legs extending outwardly therefrom so that one pair of spaced apart arms extends outwardly from one side of the body member, another pair of spaced apart arms extends outwardly from the opposite side of the body member, and a pair of spaced apart arms extends downwardly from the body member. The hanger is fabricated from a plastic or rubber-like material to permit the arms and legs of each pair to be bent and spread apart from each other in order to press a garment hanging on the hanger into shape to avoid any creasing and wrinkling thereof. Preferably, reinforcement members are disposed in the arms and legs to maintain the arms and legs in their bent positions. Each of the arms and legs is bent downwardly and folded back on itself to provide a compact storage position for the hanger.

20 Claims, 1 Drawing Sheet

CLOTHES PRESS HANGER

BACKGROUND OF THE INVENTION

The invention relates to a garment hanger and, more particularly, to a clothes press hanger upon which clothes can be hung and pressed into shape.

Garment hangers are well known, being usually constructed with upper shoulder portions for supporting a coat, shirt, dress or similar garment and a lower horizontal bar upon which to hang trousers, skirts and other similar garments or articles of apparel. A hook member is usually secured at the center between the shoulder portions to support the hanger on a rod, bar or the like. Though there have been many changes of the usual construction of the garment hanger in most of the prior art garment hangers, the garment is still loosely draped on the hanger so that the garment's shape is not maintained. In some cases, paper or tissues are stuffed into the garment in order to maintain the garment's shape when hanging on the hanger, which is very costly and time consuming.

U.S. Pat. No. 2,608,324 discloses a hanger that includes V-shaped garment supporting members which can hold a portion of a skirt in shape while hanging thereon. U.S. Pat. No. 2,757,835 discloses a garment hanger having adjustable arms which can be spread apart to hold a pair of trousers on the ends thereof. U.S. Pat. No. 4,556,158 discloses a one piece garment hanger which includes an upper bar which can be pivoted towards a lower bar and locked in place by a latch to hold a garment draped over the upper bar. However, none of these above mentioned patents disclose a hanger which can hold and press an entire garment into shape.

SUMMARY OF THE INVENTION

It is, accordingly, an object of the present invention to provide a clothes press hanger which avoids the problems of the prior art hangers.

Another object of the present invention is to provide a clothes press hanger upon which clothes can be hung and pressed into shape.

A further object of the present invention is to provide a clothes press hanger which has an integral one piece construction.

Still another object of the present invention is to provide a clothes press hanger as described above which will support a garment in such a manner as to prevent undesirable creasing and wrinkling of the garment.

A further object of the present invention is to provide a clothes press hanger as described above that is simple and practical in construction, which is economical to manufacture and which is strong and reliable in use.

Another object of the present invention is to provide a clothes press hanger that can be bent and folded into a small and compact structure for storage thereof when not in use.

And still a further object of the present invention is to provide a clothes press hanger that is fabricated from a plastic or rubber-like material to permit the bending thereof into various shapes.

Another object of the present invention is to provide a clothes press hanger as described above which includes reinforcing means to maintain the hanger in its various bent shapes.

A still further object of the present invention is to provide a clothes press hanger as described above which includes a series of arms and legs extending outwardly therefrom which can be bent and spread apart from each other to press a garment into shape while the garment is hanging thereon.

Briefly, in accordance with the present invention, there is provided a clothes press hanger including a body member, a hook member and a series of arms and legs extending outwardly therefrom, one pair of arms extending outwardly from one side of the body member thereof, a second pair of arms extending outwardly from an opposite side of the body member, and a pair of legs extending downwardly from the body member. The arms and legs can be bent and spread apart into various shapes. The hanger is fabricated from a plastic or rubber-like material and includes reinforcement means to maintain the arms and legs in their various bent shapes. The sleeves of a garment are placed on the arms, and the body portion of the garment is placed on the legs, so that when the arms and legs are bent and spread apart from each other to press against the garment, the garment is pressed into shape to avoid creasing and wrinkling thereof.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawings, like reference characters designate like parts.

DESCRIPTION OF THE PREFERRED EMBODIMENT

Figure 1:
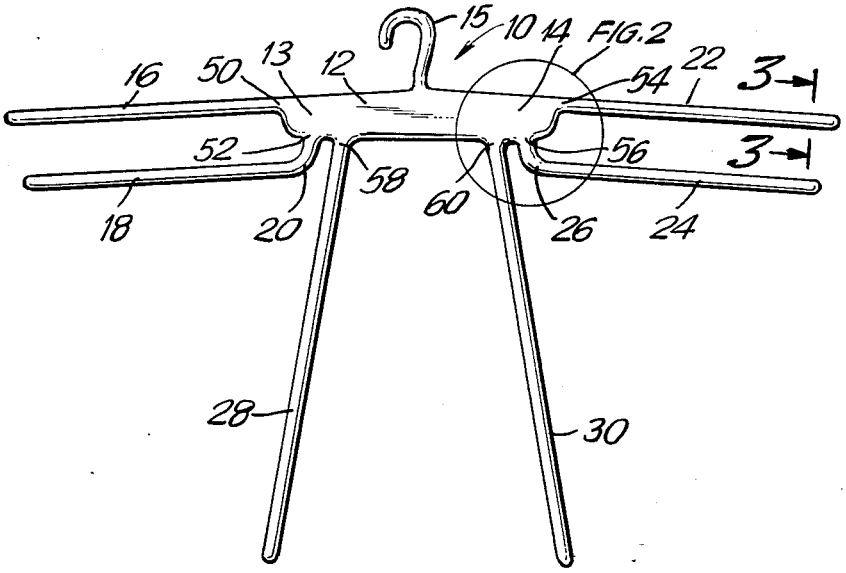
FIG. 1 is a front elevational view showing a clothes press hanger in accordance with the present invention.

Referring now to the drawing, FIG. 1 discloses a clothes press hanger 10, in accordance with the present invention, having an integral one piece construction. The hanger 10 includes a body member 12 having coat, shirt, dress or similar garment. A hook member 15 extends upwardly from the center of the top portion of the body member 12 between the shoulder portions 13, 14. The hook member 15 has a conventional shape to permit the hanger 10 to be hung on a bar, hook and the like in a conventional manner.

A first pair of spaced apart arms 16, 18 extends outwardly from one side of the body member 12. The upper arm 16 is connected to the top portion of the shoulder portion 13 of the body member 12, and the lower arm 18 is connected to the bottom portion of the body member 12 adjacent the end portion thereof. As shown, the lower arm 18 can be bent at 20 in order to extend outwardly in the same direction as the upper arm 16.

In a like manner, a second pair of arms 22, 24 extends outwardly from the other side of the body member 12.

The upper arm 22 is connected to the top portion of the shoulder portion 14 of the body member 12, and the lower arm 24 is connected to the bottom portion of the body member 12 adjacent the end portion thereof. As shown, here again, the lower arm 24 can be bent at 26 in order to extend outwardly in the same direction as the upper arm 22.

A pair of legs 28, 30 extends downwardly from the bottom portion of the body member 12. The legs 28, 30 are spaced apart from each other with the leg 28 being adjacent to the side of the body member 12 having the arms 16 and 18 thereon, and the leg 30 being adjacent to the other side of the body member 12 having the arms 22 and 24 thereon. The legs 28, 30 are disposed between the arms 18, 24.

The hanger 12 is fabricated from a plastic or rubber-like material so that the arms 16, 18 and 22, 24 and the legs 28, 30 of each pair can be bent and spread apart from each other in order to press a garment hanging on the hanger into shape to avoid any creasing and wrinkling of the garment.

Figure 3:
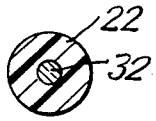
FIG. 3 is a cross sectional view taken along line 3—3 of FIG. 1.

As best shown in FIG. 3, the arms and legs are bar-like having circular cross section, where the diameters of the arms and legs are equal to each other, being approximately ½ inch thick so that the arms and legs are substantially straight circular bars. Preferably, the body member 12 has a maximum longitudinal length of approximately 24 inches from one side to the opposite side thereof. Preferably, each of the arms 16, 22 also has a longitudinal length of approximately 24 inches, where the arms 18, 24 are slightly longer than the arms 16, 22 to provide for the bends 20, 26 therein. Each of the legs 28, 30 preferably has a longitudinal length of approximately 36 inches. Obviously, the above mentioned lengths of the body member, arms and legs can be changed during the manufacture thereof, being either increased or decreased, according to the required needs for which the hanger 10 is to be used.

Figure 2:
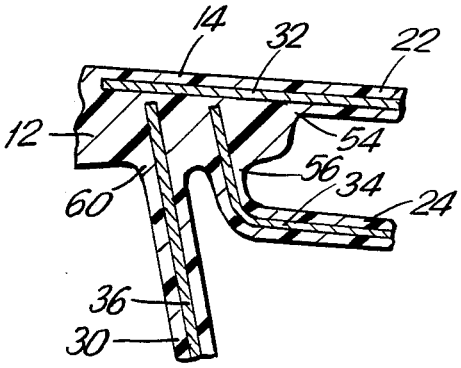
FIG. 2 is a cross sectional view of the area indicated by FIG. 2 in FIG. 1.

The body member 12, the arms 16, 18 and 22, 24 and the legs 28, 30 are preferably provided with reinforcement means to insure that the arms and legs are maintained in their bent positions. As shown in FIGS. 2 and 3, the reinforcement means include metal rods 32, 34 and 36. The metal rod 32 extends through the center of the arm 22, and then extends into the body member 12. The metal rod 34 extends through the center of the arm 24, and then also extends into the body member 12. The metal rod 36 extends through the center of the leg 30, and then also extends into the body member 12. Accordingly, similar three metal rods in a like manner also extend through each of the arms 16, 18 and the leg 28, where a showing thereof is not thought necessary for an understanding thereof. It is further noted, that if required, a metal rod in a like manner can also extend through the hook member 15 and into the body member 12 in order to reinforce the hook member 15.

Figure 4:
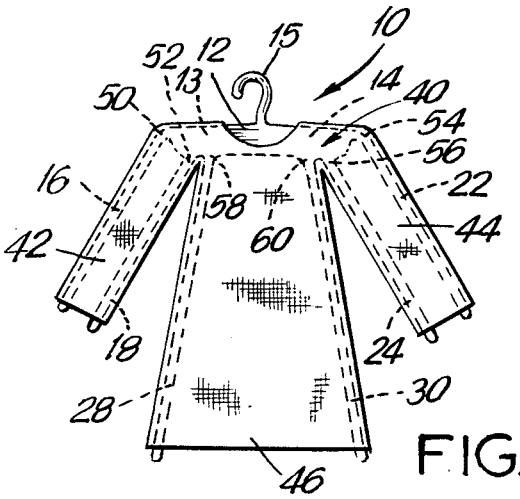
FIG. 4 is a front elevational view showing a garment disposed on the clothes press hanger of FIG. 1.

In use, as shown in FIG. 4, a garment 40 is hung on the shoulder portions 13 and 14 of the hanger 10 so that the hook member 15 extends outwardly from the open neck of the garment 40. The arms 16, 18 extend through one sleeve 42 of the garment 40, and the arms 22, 24 extend through the other sleeve 44 of the garment 40. The legs 28, 30 are disposed within the body portion 46 of the garment 40 along the inside sides thereof.

Accordingly, the arms 16, 18 are bent at 50, 52, respectively, to spread the arms 16, 18 apart from each other in order to press against the inside portion of the garment sleeve 40. Likewise, the arms 22, 24 are bent at 54, 56, respectively, to spread the arms 22, 24 apart from each other in order to press against the inside portion of the garment sleeve 44. In a similar manner, the legs 28, 30 are bent at 58, 60, respectively, to spread the legs 28, 30 apart from each other to press against the inside sides of the garment body portion 46. Thus, the garment 40 hanging on the hanger 10 is pressed into shape to avoid any creasing and wrinkling thereof.

Figure 5:
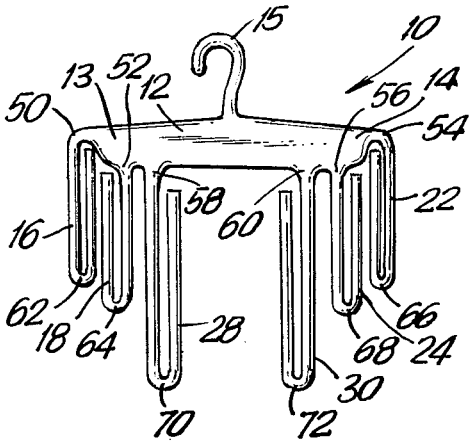
FIG. 5 is a front elevational view showing the clothes press hanger in a storage position.

After or before the use of the hanger 10, the legs and arms of the hanger 10 can be bent and folded into a compact storage position as shown in FIG. 5. As shown, the arm 16 is bent at 62 and folded back on itself, and the arm 18 is bent at 64 and folded back on itself, so that the folded free portions of the arms 16, 18 are adjacent and face each other. Likewise, the arm 22 is bent at 66 and folded back on itself, and the arm 24 is bent at 68 and folded back on itself, so that the folded free portions of the arms 22, 24 are adjacent and face each other. In a similar manner, the leg 28 is bent at 70 and folded back on itself, and the leg 30 is bent at 72 and folded back on itself, so that the folded free portions of the legs 28, 30 are facing each other. In this compact storage position, the hanger 10 is easier to handle, and can be stored or hung in a small storage or closet area.

Numerous changes in the structure hereinabove described may suggest themselves to those skilled in the art, however, it is understood that the present disclosure relates to a preferred embodiment of the invention, and is not to be construed as a limitation of the invention.

What is claimed is:

1. A clothes press hanger comprising:

a body member having shoulder portions on opposite sides thereof;

a hook member extending upwardly from a center of a top portion of said body member between said shoulder portions;

a first pair of arms extending outwardly from one side of said body member, said arms being spaced apart;

a second pair of arms extending outwardly from an opposite side of said body member, said arms of said second pair being spaced apart; and means for permitting said first pair of arms to be bent and spread apart from each other, and for also permitting said second pair of arms to be bent and spread apart from each other, in order to press a garment hanging on said hanger into shape to avoid any creasing and wrinkling thereof.

2. A clothes press hanger according to claim 1, wherein said hanger is fabricated from a bendable plastic or rubber-like material.

3. A clothes press hanger according to claim 2, wherein said body member and said arms include reinforcement means to maintain said arms in their bent positions.

4. A clothes press hanger according to claim 3, where said reinforcement means includes metal rods with a separate metal rod extending through each of said arms, respectively, and extending into said body member.

5. A clothes press hanger according to claim 1, wherein each of said arms has a longitudinal length approximately equal to a maximum longitudinal length of said body member.

6. A clothes press hanger according to claim 1, wherein each of said arms is bent downwardly and folded back on itself to provide a compact storage position for said hanger.

7. A clothes press hanger according to claim 1, wherein one arm of each of said first and second pairs is connected to said top portion of said body member, and the other arm of each of said first and second pairs is connected to a bottom portion of said body member.

8. A clothes press hanger according to claim 1, wherein a pair of spaced apart legs extend downwardly from a bottom portion of said body member, one leg being adjacent to said one side of said body member, and the other leg being adjacent to said opposite side of said body member, said means permitting said legs to be bent and spread apart from each other.

9. A clothes press hanger according to claim 8, wherein said hanger is fabricated from a bendable plastic or rubber-like material.

10. A clothes press hanger according to claim 9, wherein said body member, said arms and said legs include reinforcement means to maintain said arms and legs in their bent positions.

11. A clothes press hanger according to claim 10, wherein said reinforcement means includes metal rods with separate metal rod extending through each of said arms and legs, respectively, and extending into said body member.

12. A clothes press hanger according to claim 8, wherein each of said arms and legs has a minimum longitudinal length at least equal to a maximum longitudinal length of said body member.

13. A clothes press hanger according to claim 8, wherein each of said arms and legs has a circular cross section of the same size.

14. A clothes press hanger according to claim 8, wherein each of said arms and legs is bent downwardly and folded back on itself to provide a compact storage position for said hanger.

15. A clothes press hanger comprising:

a body member having shoulder portions on opposite sides thereof;

a hook member extending from a center of a top portion of said body member between said shoulder portions;

a pair of legs extending downwardly from a bottom portion of said body member;

one leg being adjacent one side of said body member, and the other leg being adjacent on opposite side of said body member so that said legs are spaced apart; and means for permitting said legs to be bent and spread apart from each other in order to press a garment hanging on said hanger into shape to avoid any creasing and wrinkling thereof.

16. A clothes press hanger according to claim 15, wherein said hanger is fabricated from a bendable plastic or rubber-like material.

17. A clothes press hanger according to claim 16, wherein said body member and said legs include reinforcement means to maintain said legs in their bent positions.

18. A clothes press hanger according to claim 17, wherein said reinforcement means includes metal rods with a separate metal rod extending through each of said legs, respectively, and extending into said body member.

19. A clothes press hanger according to claim 15, wherein each of said legs has a longitudinal length longer than a maximum longitudinal length of said body member.

20. A clothes press hanger according to claim 15, wherein each of said legs is bent and folded back on itself to provide a compact storage position for said hanger.

* * * * *